US009364063B1

(12) United States Patent
Dandia

(10) Patent No.: US 9,364,063 B1
(45) Date of Patent: Jun. 14, 2016

(54) MONEY BELT WITH ELECTRONIC ALARM

(71) Applicant: Ghulam Mohammad Dandia, Southwest Ranches, FL (US)

(72) Inventor: Ghulam Mohammad Dandia, Southwest Ranches, FL (US)

( * ) Notice: Subject to any disclaimer, the term of this patent is extended or adjusted under 35 U.S.C. 154(b) by 0 days.

(21) Appl. No.: 14/949,117

(22) Filed: Nov. 23, 2015

(51) Int. Cl.

| | |
|---|---|
| ***A45C 13/18*** | (2006.01) |
| ***A45C 13/24*** | (2006.01) |
| ***G08B 13/14*** | (2006.01) |
| ***A45C 1/04*** | (2006.01) |
| *A45F 5/02* | (2006.01) |

(52) U.S. Cl.
CPC . *A45C 13/24* (2013.01); *A45C 1/04* (2013.01); *A45C 13/18* (2013.01); *A45F 5/021* (2013.01); *G08B 13/149* (2013.01); *G08B 13/1445* (2013.01)

(58) Field of Classification Search
CPC .... A45C 13/18; A45C 13/24; G08B 13/1445; G08B 13/149
USPC ..... 224/587, 183
See application file for complete search history.

(56) References Cited

U.S. PATENT DOCUMENTS

| | | | | | |
|---|---|---|---|---|---|
| D29,490 | S | * | 10/1898 | Varni-Gardinier | 224/587 |
| 2,474,495 | A | * | 6/1949 | Pollak | A45C 1/04 190/903 |
| 2,693,164 | A | | 11/1954 | Bruchlos | |
| 2,983,412 | A | * | 5/1961 | Ferguson | A45C 1/04 224/235 |
| 3,578,225 | A | * | 5/1971 | Schroeder | A45F 3/02 150/108 |
| 3,648,906 | A | * | 3/1972 | Ross | A45F 5/00 224/587 |
| 3,851,326 | A | * | 11/1974 | Costa | A45C 13/24 200/DIG. 2 |
| 4,067,290 | A | * | 1/1978 | Hartley | A45C 13/24 116/99 |
| 4,083,321 | A | * | 4/1978 | LeBron | G08B 13/149 116/84 |
| 4,139,133 | A | * | 2/1979 | Repka | A45C 1/04 2/920 |
| 4,236,463 | A | * | 12/1980 | Westcott | E05G 1/14 109/33 |
| 4,490,858 | A | | 1/1985 | Batavier | |
| 4,584,571 | A | * | 4/1986 | Smit | G08B 13/149 283/70 |
| 4,763,821 | A | * | 8/1988 | Powell | A45C 1/04 224/222 |
| 4,885,570 | A | * | 12/1989 | Chien | G08B 13/1445 150/101 |

(Continued)

FOREIGN PATENT DOCUMENTS

| | | | | | |
|---|---|---|---|---|---|
| FR | 2836343 | A1 | * | 8/2003 | A45C 13/20 |
| GB | 2390295 | A | * | 1/2004 | A45C 13/20 |

*Primary Examiner* — Justin Larson
(74) *Attorney, Agent, or Firm* — Malin Haley DiMaggio & Bowen, P.A.

(57) ABSTRACT

An electronically secured money belt has a pouch attached to an elongated waist band and an electronic control circuit. The elongated waist band includes a wire mesh circuit electrically coupled to the electronic control circuit whereby damaging one or more wire elements of the wire mesh circuit causes the electronic control circuit to activate an audible alarm. In some embodiments, pouch includes a closure, such as a snap, button, or zipper that doubles as an electronic switch electrically coupled to the electronic control circuit. The closure closes the electronic control circuit to activate the security system. A master switch is located on the waistband and is electrically coupled to the electronic control circuit. The master switch is operable to activate or deactivate said electronic control circuit and therefore the security system. A magnet-attachable accessory engages a magnet on the belt to provide an auxiliary means to activate the security system.

7 Claims, 4 Drawing Sheets

(56) References Cited

U.S. PATENT DOCUMENTS 4,998,653 A * 3/1991 LaBelle ..... A45F 5/00 224/240
5,285,833 A * 2/1994 Haxby ..... A45C 1/04 150/102
5,337,936 A * 8/1994 Blum ..... A45C 1/04 224/240
5,345,221 A * 9/1994 Pons ..... G08B 13/149 340/571
5,540,366 A * 7/1996 Coomber ..... A41F 9/002 224/587
5,622,301 A * 4/1997 Blum ..... A45C 1/04 224/240
5,955,948 A * 9/1999 Howell ..... G08B 21/0297 150/101
6,026,662 A * 2/2000 Schlipper ..... A45C 3/001 70/14
6,227,424 B1 * 5/2001 Roegner ..... A45C 1/04 150/131
6,281,800 B1 * 8/2001 Sizemore ..... G08B 21/0297 340/573.1
6,925,691 B2 * 8/2005 Bristel ..... A45C 1/04 150/102
7,069,753 B2 * 7/2006 Schlipper ..... A45C 13/1046 70/14
7,088,257 B2 * 8/2006 Weekes ..... A45C 13/18 324/541
7,277,013 B2 * 10/2007 Yen ..... A45C 13/24 150/102
7,422,131 B2 * 9/2008 Cohen ..... A45F 3/04 224/651
7,628,112 B2 * 12/2009 Lindskog ..... E05G 1/14 109/25
7,772,973 B2 * 8/2010 Shih ..... G08B 13/1445 150/101
7,779,766 B2 * 8/2010 Mullen ..... A45C 13/24 109/25
8,152,374 B2 * 4/2012 Shaul ..... A45C 13/002 150/105
8,267,290 B2 * 9/2012 Schlipper ..... A45F 3/04 224/259
8,434,577 B1 * 5/2013 Al-Qaffas ..... A45C 13/24 180/65.1
8,925,181 B2 * 1/2015 Godshaw ..... A45C 3/001 150/101
2003/0178459 A1 * 9/2003 Aniwanou ..... A45C 1/04 224/587
2005/0017040 A1 * 1/2005 Roberts ..... A45C 13/18 224/617
2005/0199658 A1 * 9/2005 Brown ..... A45F 3/04 224/153
2006/0180619 A1 * 8/2006 MRM Holdings Limited ..... A45C 3/001 224/191
2007/0240798 A1 * 10/2007 Bihler ..... A45C 13/18 150/102
2009/0289090 A1 * 11/2009 Fullerton ..... A45F 5/02 224/183
2010/0243114 A1 * 9/2010 Hai ..... A45C 3/001 150/102
2011/0192857 A1 * 8/2011 Rothbaum ..... B25F 1/00 220/694
2011/0233253 A1 * 9/2011 Worthington ..... A45C 13/18 224/645
2014/0312083 A1 * 10/2014 Scott ..... A45F 5/021 224/183

* cited by examiner

MONEY BELT WITH ELECTRONIC ALARM

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to wearable devices and more particularly to a wearable money-storing belt with an internal electric alarm system.

2. Description of Related Art

Despite the increased popularity of electronic payment methods, individuals still rely on carrying paper and coin currency, particularly when traveling in a foreign country. Due to the widespread petty theft in many countries, particularly targeted at tourists, there is a constant need for devices to carry currency in a discrete manner. Many forms of personal clandestine currency carriers are known in the art, such as belts, satchels, pouches, and various other forms of hidden wallets. A typical money belt includes a primary pouch and a waistband and is intended to be worn underneath the wearer's outer garments, with the pouch portion aligned at the wearer's stomach. The pouch may have one or more zipper or hook and pile fasteners (known under the trademark Velcro) pockets or compartments for storing currency, passports, and other valuables. These wearable money belts provide a significant advantage over traditional pocket wallets or even neck-worn safety wallets as the pouch can remain hidden and out of sight behind the wearer's clothing at the stomach region, eliminating the ability to "pick-pocket." However, the problem with these conventional money belts is that thieves have become more intelligent and have taken to strategies involving snipping the waistband (often along with the wearer's outer clothing) and grasping the valuables pouch quickly away from the body of the wearer. Accordingly, there is a significant need in the art for an improved money belt that accounts for the potential theft.

Several attempts have been made at providing a protective device for valubles; however none have adequately addressed all of the problems with the present state of the art. For example, U.S. Pat. No. 4,490,858 to Batavier discloses a garment with pockets having a point in the vicinity of the end of the pocket inlet connected by a coupling part to a resilient element which serves to issue an acoustic, or other signal in the case of pickpocketing. While providing an audible alert of a potential pick-pocketing, the device is built into the garment and thus is not portable. Also, it conceivable will make false alarms in the case that the wearer intends to access his own pocket.

U.S. Pat. No. 2,693,164 to Bruchlos describes an anti-theft wallet that includes a flat anti-theft mechanism that serves as a noise making sound board for producing an audible alarm when the wallet locking mechanism is operated. Although the wallet is portable, it does not prevent a thief from pick-pocketing the entire wallet and also does not prevent against false alarms when the true owner wishes to access the wallet.

It is, therefore, to the effective resolution of the aforementioned problems and shortcomings of the prior art that the present invention is directed. However, in view of the protective devices in existence at the time of the present invention, it was not obvious to those persons of ordinary skill in the pertinent art as to how the identified needs could be fulfilled in an advantageous manner.

SUMMARY OF THE INVENTION

The present invention discloses various embodiments of an electronically secured money belt and related accessories. In some embodiments, the money belt comprises a pouch disposed on an elongated waist band and an electronic control circuit. The elongated waist band includes a wire mesh circuit electrically coupled to the electronic control circuit whereby damaging one or more wire elements of the wire mesh circuit causes the electronic control circuit to activate an audible alarm. In some embodiments, the pouch includes a closure means, such as a snap, button, or zipper that doubles as an electronic switch electrically coupled to the electronic control circuit. The closure means is operable to close said electronic control circuit to activate the security system. In some embodiments, a master switch is disposed on the waistband and is electrically coupled to the electronic control circuit. The master switch is operable to activate or deactivate said electronic control circuit and therefore the security system.

In some embodiments, the pouch includes a secondary wire mesh circuit electrically coupled to the electronic control circuit, wherein damaging one or more wire elements of the secondary wire mesh circuit causes the electronic control circuit to activate an audible alarm. Further included on the money belt is a magnet electronically coupled to the electronic control circuit, wherein upon attaching an opposing magnet to the magnet closes said electronic control circuit. With the security system active, when the opposing magnet is removed, the system is triggered and the audible alarm will sound.

DETAILED DESCRIPTION

Figure 1A:
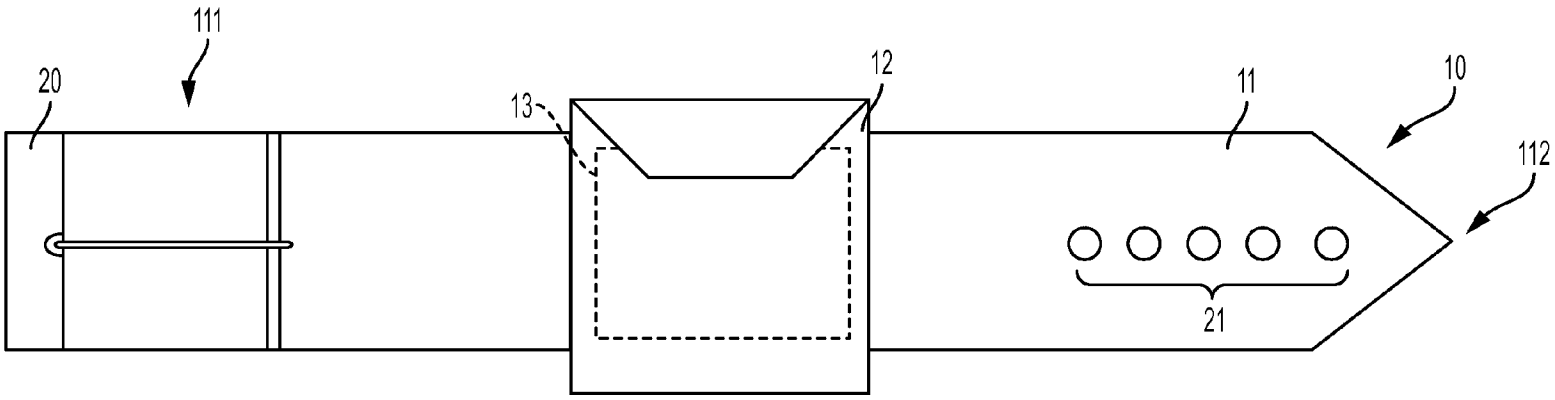
FIG. 1A is a front view of one embodiment of the money belt.
Figure 1B:
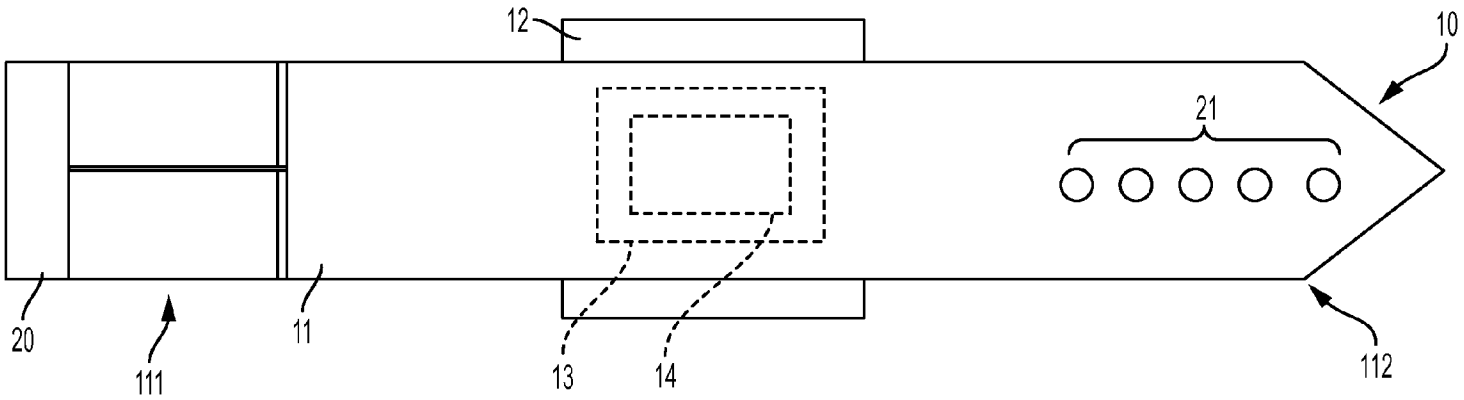
FIG. 1B is a rear view of one embodiment of the money belt.

With reference to FIGS. 1A and 1B, shown is one embodiment of the money belt 10 of the present invention. The money belt 10 generally comprises an elongated waist band 11 and a pouch 12. The elongated waist band includes a proximal end 111 with a buckle 20 and an opposing distal end 112 with a plurality of sizing holes that are configured to receive the buckle. Disposed at a predetermined position along the length of the waist band 11 is pouch 12. Pouch 12 is a re-sealable pouch that can be used to contain currency, credit cards, or any desired valuables. In some embodiments, pouch 12 is sewn onto or otherwise permanently attached to the waist band 11. In other embodiments, pouch 12 is removably attached to the waist band 11. Disposed inside and attached to the pouch 12 is an electronic control circuit 13 that will be further described. Optionally, a magnet 14 is disposed inside and attached to the pouch. In some embodiments, the magnet 14 is used to removably attach a separate clutch, wallet, or handbag article as further described.

Figure 2A:
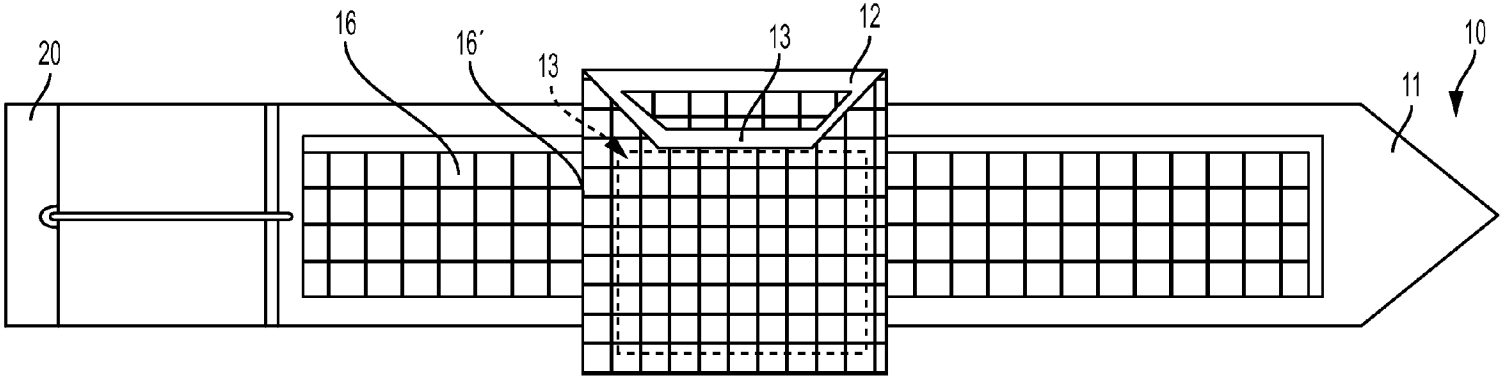
FIG. 2A is a front section view of one embodiment of the money belt.
Figure 2B:
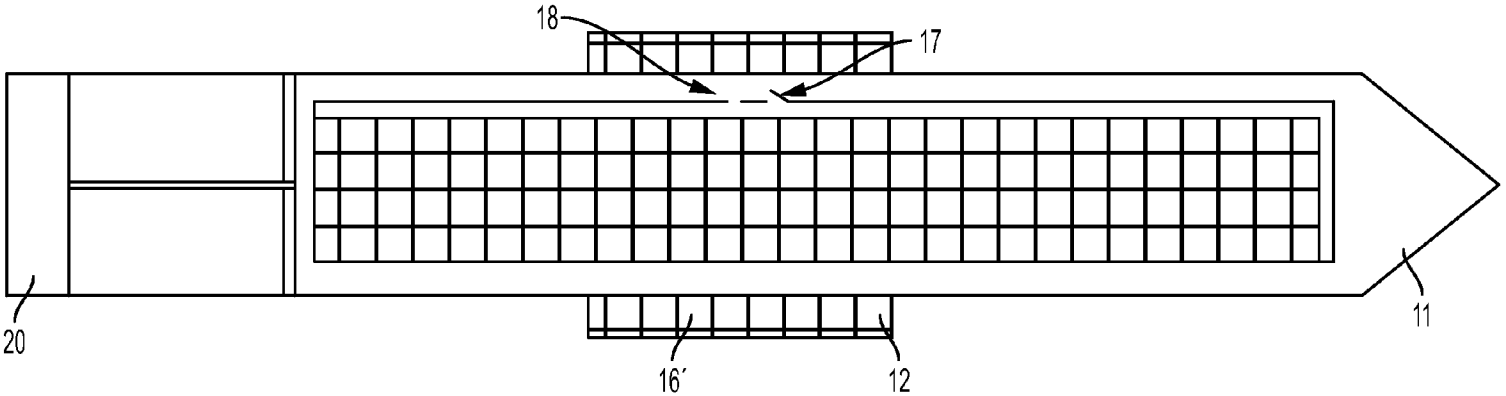
FIG. 2B is a rear section view of one embodiment of the money belt.

FIGS. 2A and 2B depict the internal components of one embodiment of the present invention. As shown, disposed inside and along the length of the waistband 11 is an electronic wire mesh circuit 16. In some embodiments, the mesh circuit comprises a plurality of wire elements, such as copper wire elements, wired in series. The wire mesh circuit 16 is electronically coupled to the electronic control circuit 13 disposed in the pouch 12 to form an electronic security system. In some embodiments, the mesh circuit 16 is electronically coupled to the control circuit 13 at a junction 18 on the rear side of the belt 10, adjacent to the pouch 12. The pouch 12 includes a closure means 15 such as a snap, button, zipper, or combinations thereof. The closure means 15 functions both as a physical closure of the pouch 12 and as an electronic switch to close the security system as further described. A secondary wire mesh circuit 16', comprised of wire elements in series, may be disposed inside the pouch 12 and electronically coupled to the electronic control circuit 13. Optionally, a master switch 17 is disposed on the waistband 11 in series with the various circuit elements to provide the user with the ability to activate and deactivate the security system. The master switch 17 may be configured as a manual switch, digital switch, or a biometric/digital switch such as a digital fingerprint reader.

Figure 3:
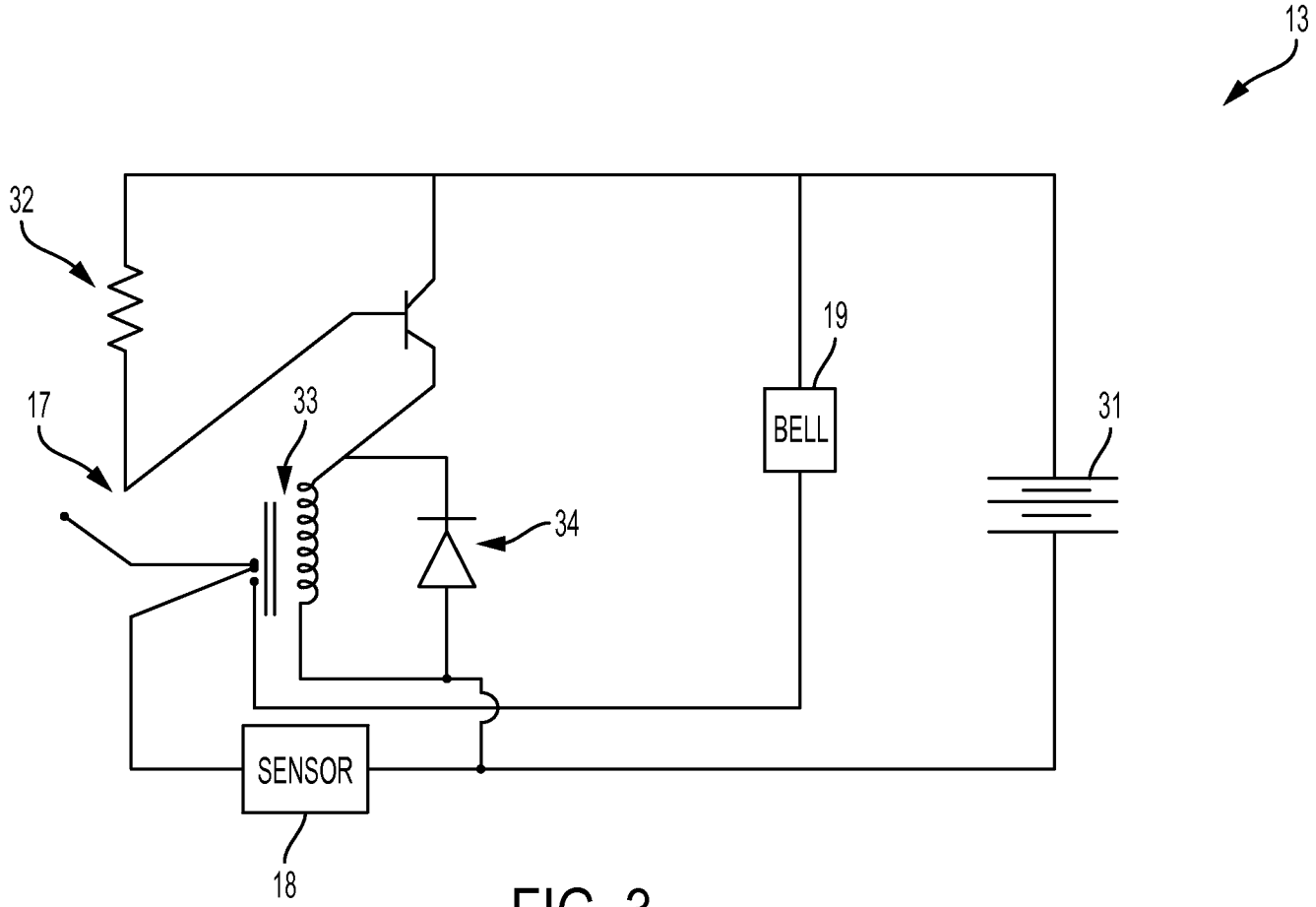
FIG. 3 is a schematic of one embodiment of the electronic control circuit of the present invention.

FIG. 3 is a circuit diagram depicting the electronic control circuit 13 of the present invention. The circuit 13 includes a battery electrical power supply 31, and an audible alarm 19. The power supply 31 may comprise a battery power source that provides power to the control circuit 13 and the rest of the security system. The master on-off switch 17 is in series with a resister 32 and the sensor 18, which electrically couples the control circuit 13 to the wire mesh circuit 16 (FIGS. 2A and 2B). In some embodiments, the secondary wire mesh circuit 16' is also wired in series with the control circuit 13. An inductor 33 is in parallel with the master switch 17 and, in some embodiments, a diode 34 is placed across the inductor to avoid kickback when the master switch 17 is activated/deactivated. The audible alarm 19, such as an electronic bell, speaker, or the like is in series with the master switch 17 and power supply 31. When the master switch 17 is closed, the device is armed. The belt 19 will sound if the sensor 18 is opened or the circuit is opened. If the sensor is a magnet that is removed opening the circuit the bell 19 will ring. The bell 19 will also ring if the circuit wiring represented by the sensor 18 is cut.

The alarm belt 10 of the present invention is configured such that if there is an attempt to disturb, cut, or otherwise damage the waistband 11 or pouch 12 in order to retrieve the pouch 12 and its contents, an audible alarm will sound, having a deterrent effect on the thief and/or alerting surrounding individuals that a crime is in progress. Accordingly, in some embodiments, the security system is armed when the closure means 15 is closed and the master switch 17 is activated, thereby closing the wire mesh circuit 16 and the electronic control circuit 13 and powering the security system. In the case that the secondary wire mesh circuit 16' is included, it too will be closed. If an attempt is made to disturb, cut, or damage the waistband 11, at least a portion of the wire mesh circuit 16 will be severed, thereby shorting the circuit and causing the audible alarm 19 to sound. Similarly, if an attempt is made to disturb, cut, or damage the pouch 12, at a least a portion of the secondary wire mesh circuit 16' will be severed, thereby shorting the circuit and causing the audible alarm 19 to sound. Further still, in some embodiments, if an attempt is made to disturb the closure means 15 of the pouch 12, the circuit will be severed, thereby shorting the circuit and causing the audible alarm 19 to sound.

Figure 4A:
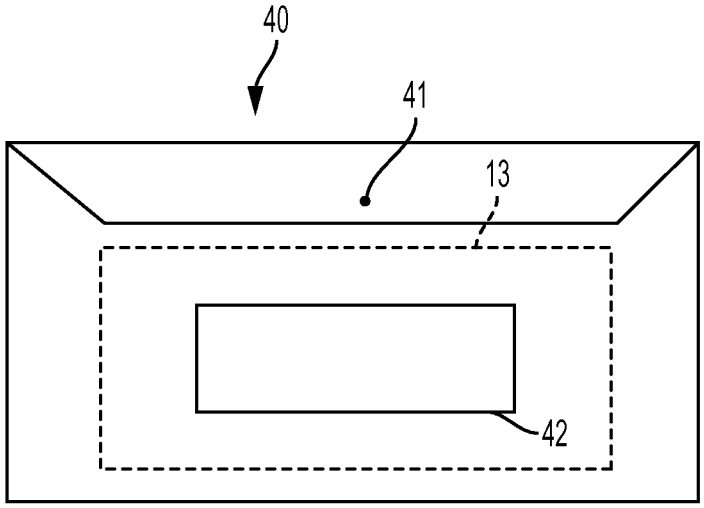
FIG. 4A is a rear view of an optional wallet feature of the present invention.
Figure 4B:
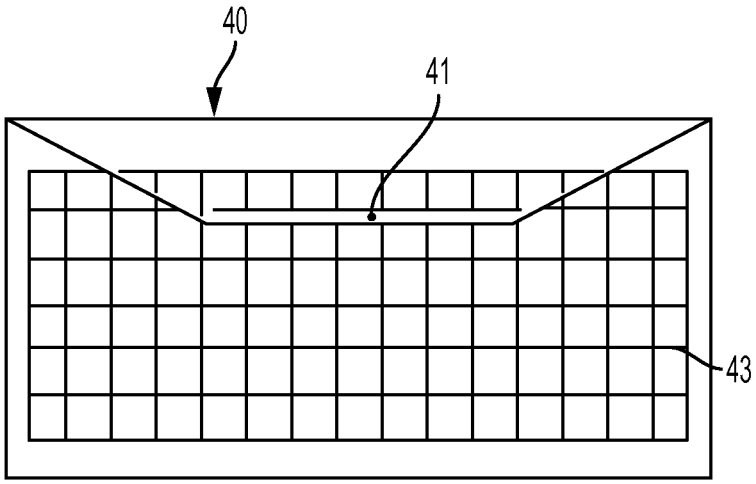
FIG. 4B is a rear section view of an optional wallet feature of the present invention.

With reference to FIGS. 4A and 4B, shown is an alternative and optional aspect of the present invention. A wallet 40, configured a bill sized wallet or optionally as a clutch or handbag, includes electronic control circuit 13 substantially as shown and described above. The wallet 40 includes a closure means 41 such as a snap, button, zipper, or combinations thereof. The closure means 41 functions both as a physical closure of the wallet 40 and as an electronic switch to close the circuit of the security system as further described. In some embodiments, also disposed within the wallet 40 is a magnet 42 that is functional to close the electronic control circuit 13 when magnetically attracted to and/or attached to another magnet on the wearer's body. In some embodiments, the second magnet is the magnet 14 embedded in the pouch 12 of the money belt 10 shown in FIG. 1. In other embodiments, the magnet 42 engages a magnet attached to the wearer's clothing, such as pants, a shirt, or an undergarment such as a brassiere. With the magnet 42 engaged with the magnet 14 or an auxiliary magnet, and optionally with the closure means 41 shut, the electronic control circuit is closed and the security system can be armed substantially as described above. If an attempt is made to snatch the wallet 40, the magnetic seal will be disturbed, causing a short in the circuit, resulting in activation of the audible alarm 19.

With reference to FIG. 4B, in some embodiments the wallet 40 includes its own internal wire mesh circuit 43 comprising a plurality of wire elements. This provides an additional level of security against any attempt to damage, cut, or otherwise disturb the wallet. The wire mesh circuit 43 is electrically coupled to the control circuit 13 similar to the manner described above with respect to the waistband 11 and pouch 12. With the security system activated, if an attempt is made to disturb, cut, or damage the wallet 40, at a least a portion of the wire mesh circuit 43 will be severed, thereby shorting the circuit and causing the audible alarm 19 to sound. While specific embodiments have been described in detail, those with ordinary skill in the art will appreciate that various modifications and alternatives to those details could be developed in light of the overall teachings of the disclosures. Accordingly, the particular arrangements disclosed are meant to be illustrative only and not limiting of the invention, which is to be given the full breadth of the appended claims, and any and all equivalents thereof.

What is claimed is:

1. A money belt, comprising:

a pouch disposed on an elongated waist band;

an electronic control circuit;

said elongated waist band including a wire mesh circuit electrically coupled to said electronic control circuit; and wherein damaging one or more wire elements of said wire mesh circuit causes said electronic control circuit to activate an audible alarm.

2. The money belt of claim 1, wherein said pouch includes a closure means, said closure means comprising an electronic switch electrically coupled to said electronic control circuit, wherein said closure means is operable to close said electronic control circuit.

3. The money belt of claim 1, further including a master switch disposed on said waistband, said switch electrically coupled to said electronic control circuit, wherein said switch is operable to activate or deactivate said electronic control circuit.

4. The money belt of claim 1, wherein said electronic control circuit includes a power supply.

5. The money belt of claim 1, wherein said pouch includes a secondary wire mesh circuit electrically coupled to said electronic control circuit, wherein damaging one or more wire elements of said secondary wire mesh circuit causes said electronic control circuit to activate an audible alarm.

6. The money belt of claim 1, further including a magnet electronically coupled to said electronic control circuit, wherein upon attaching an opposing magnet to said magnet closes said electronic control circuit.

7. The money belt of claim 6, wherein removal of said opposing magnet causes said audible alarm to sound.

* * * * *